US011237526B2

(12) United States Patent
Kita et al.

(10) Patent No.: US 11,237,526 B2
(45) Date of Patent: Feb. 1, 2022

(54) ANTENNA DEVICE AND WRISTWATCH TYPE ELECTRONIC DEVICE

(71) Applicant: Casio Computer Co., Ltd., Tokyo (JP)

(72) Inventors: Kazunori Kita, Tokyo (JP); Hiroshi Katsuda, Kodaira (JP); Hiroaki Otsubo, Higashimurayama (JP)

(73) Assignee: Casio Computer Co., Ltd., Tokyo (JP)

( * ) Notice: Subject to any disclaimer, the term of this patent is extended or adjusted under 35 U.S.C. 154(b) by 158 days.

(21) Appl. No.: 16/572,091

(22) Filed: Sep. 16, 2019

(65) Prior Publication Data

US 2020/0103833 A1 Apr. 2, 2020

(30) Foreign Application Priority Data

Oct. 2, 2018 (JP) ..... JP2018-187197

(51) Int. Cl.

| | |
|---|---|
| ***H01Q 1/12*** | (2006.01) |
| ***G04R 60/10*** | (2013.01) |
| ***H01Q 1/24*** | (2006.01) |
| ***H01Q 1/27*** | (2006.01) |
| ***H01Q 13/10*** | (2006.01) |

(Continued)

(52) U.S. Cl.

CPC ..... *G04R 60/10* (2013.01); *G04G 21/04* (2013.01); *H01Q 1/24* (2013.01); *H01Q 1/273* (2013.01); *H01Q 7/00* (2013.01); *H01Q 9/30* (2013.01); *H01Q 13/10* (2013.01)

(58) Field of Classification Search

CPC ..... H01Q 1/273; H01Q 7/00; H01Q 1/243; H01Q 9/42; H01Q 21/28; H01Q 1/48; H01Q 9/0407; H01Q 1/38; H01Q 1/241; H01Q 1/52; H01Q 1/521; H01Q 9/0421;

(Continued)

(56) References Cited

U.S. PATENT DOCUMENTS

| | | | | |
|---|---|---|---|---|
| 10,271,299 | B1 * | 4/2019 | Sayem | G04R 60/08 |
| 2007/0070818 | A1 * | 3/2007 | Inomata | G04R 60/12 368/10 |

(Continued)

FOREIGN PATENT DOCUMENTS

| | | | |
|---|---|---|---|
| CN | 103943945 | A | 7/2014 |
| JP | 2013-183437 | A | 9/2013 |

OTHER PUBLICATIONS

Chinese Office Action dated Sep. 9, 2020 for the corresponding Chinese Patent Application No. 201910925883.X, 18 pages. (With English Machine Translation).

(Continued)

*Primary Examiner* — Linh V Nguyen

(74) *Attorney, Agent, or Firm* — Seed IP Law Group LLP

(57) ABSTRACT

An antenna device includes a parasitic antenna which is a metal member used as a windshield fixing frame of a wristwatch type electronic device, and a feed antenna which is a conductor. The parasitic antenna has an annular shape, and is disposed close to the feed antenna, and is electromagnetically or capacitively coupled with the feed antenna, and acts as a parasitic antenna to which power is fed from the feed antenna in a non-contact manner, and thereby the feed antenna and the parasitic antenna act in cooperation with each other as a circular polarized antenna for receiving radar waves which are circularly polarized waves having a predetermined wavelength.

20 Claims, 10 Drawing Sheets

(51) Int. Cl.
*H01Q 9/30* (2006.01)
*G04G 21/04* (2013.01)
*H01Q 7/00* (2006.01)

(58) Field of Classification Search
CPC ..... H01Q 1/22; H01Q 1/2283; H01Q 1/2291; H01Q 1/24; H01Q 13/10; H01Q 1/42
USPC ..... 343/718, 702, 700 MS
See application file for complete search history.

(56) References Cited

U.S. PATENT DOCUMENTS

2014/0085154 A1* 3/2014 Nagahama ..... H01Q 1/273 343/720
2014/0086027 A1* 3/2014 Yanagisawa ..... G04G 17/045 368/278
2014/0232603 A1* 8/2014 Fujisawa ..... H01Q 1/24 343/702
2014/0240181 A1 8/2014 Mamuro et al.
2014/0266922 A1* 9/2014 Jin ..... H01Q 5/314 343/702
2014/0285385 A1* 9/2014 Aoki ..... H01Q 5/378 343/702
2016/0049721 A1* 2/2016 Aizawa ..... G04G 21/04 343/718
2016/0056533 A1 2/2016 Nissinen et al.
2016/0261032 A1 9/2016 Chang et al.
2016/0308272 A1* 10/2016 Standke ..... H01Q 13/10
2017/0040701 A1* 2/2017 Hanabusa ..... H01Q 1/273
2018/0062264 A1* 3/2018 Martinis ..... H01Q 9/42
2018/0294553 A1* 10/2018 Lim ..... H01Q 1/48
2019/0245272 A1* 8/2019 Varjonen ..... G01S 19/36
2019/0312340 A1* 10/2019 Li ..... H01Q 1/22
2019/0379122 A1* 12/2019 Kenkel ..... H01Q 1/242

OTHER PUBLICATIONS

Indian Examination Report dated Mar. 16, 2021, forthe corresponding Indian Patent Application No. 201914037464, 6 pages.

* cited by examiner

ANTENNA DEVICE AND WRISTWATCH TYPE ELECTRONIC DEVICE

CROSS-REFERENCE TO RELATED APPLICATIONS

This application is based on and claims priority under 35 USC 119 from Japanese Patent Application No. 2018-187197 filed on Oct. 2, 2018, the contents of which are incorporated herein by reference.

BACKGROUND

The technical field relates to an antenna device and a wristwatch type electronic device.

Recently, there are known wristwatches (running watches), smart watches, and the like that are equipped with global positioning systems (GPSs) for outdoor use, sports, and the like. Radar waves from GPS satellites are right-handed circularly polarized waves making right hand turns. Conventionally, as GPS antennae for receiving circularly polarized waves, MSL (Micro Strip Line) antennae were often used. The MSL antennae, i.e. rectangular planar patch antennae, have patch-like antenna electrode elements provided on surfaces of dielectric ceramics positioned on a ground plate.

It becomes possible to downsize planar patch antennae, since it is possible to reduce the antenna dimension to about $\frac{1}{2}\sqrt{\varepsilon r}$ of the communication wavelength by using a material having high relative permittivity ($\varepsilon r=\varepsilon/\varepsilon 0$) for a dielectric such as a ceramic which is interposed between antenna electrodes and a ground plate. And thereby it becomes possible to incorporate planar patch antennae into small-sized devices such as timepieces (Length L or Width W of Patch=Wavelength $\lambda/\{2\sqrt{\varepsilon rel}\}$ (however, Effective Permittivity $\varepsilon rel \approx$ Relative Permittivity $\varepsilon r$)).

Even so, for wristwatches and smart watches for which it is necessary to mount a number of electronic components and mechanisms in a small-sized housing, planar patch antennae are relatively large-sized components and impose big constraints on arrangement of other components and design of mounting.

For this reason, there are known ring antennae for GPS, which are for being provided on the outer peripheries of display panels of wristwatches and have C-shaped loop elements and holes formed at the center parts, instead of rectangular dielectric patch antennae (see Japanese Patent Application Laid-Open No. 2013-183437 which is a Japanese patent literature, for example).

Meanwhile, in order to improve the reinforced waterproof performance, the impact resistance, the robustness, the environment resistance, and the like of wristwatches for outdoor use, metal backs (rear lids), and metal window frame members and so on that are formed in resin cases by insert molding are often used, even though they might look resin members.

In particular, in the case of reinforced waterproof performance equal to or higher than waterproof performance up to 10 to 20 atm (waterproof performance up to 100 to 200 m), a resin case or the like possibly cause water leak or detachment of a windshield from the case, due to expansion/contraction deformation attributable to hydraulic pressure or temperature. For this reason, in order to prevent that, it was required to provide a metal member as a windshield fixing frame.

However, in the wristwatch or the smart watch with a ring antenna for GPS disclosed in the above-mentioned patent literature, the performance, characteristics, sensitivity, or the like of the antenna may deteriorate, if a metal member is provided as a windshield fixing frame in the vicinity of the ring antenna in order to prevent water leak and detachment of the windshield from the case, which are attributable to expansion/contraction deformation which is caused by hydraulic pressure or temperature.

SUMMARY

An antenna device and a wristwatch type electronic device are disclosed.

An antenna device of an embodiment includes a metal member which is used as a windshield fixing frame of a wristwatch type electronic device, and a feed antenna which is a conductor. The metal member has an annular shape, and is disposed close to the feed antenna, and is electromagnetically or capacitively coupled with the feed antenna, and acts as a parasitic antenna to which power is fed from the feed antenna in a non-contact manner, and the feed antenna and the metal member act in cooperation with each other as a circular polarized antenna for receiving radar waves which are circularly polarized waves having a predetermined frequency.

DETAILED DESCRIPTION

Figure 1:
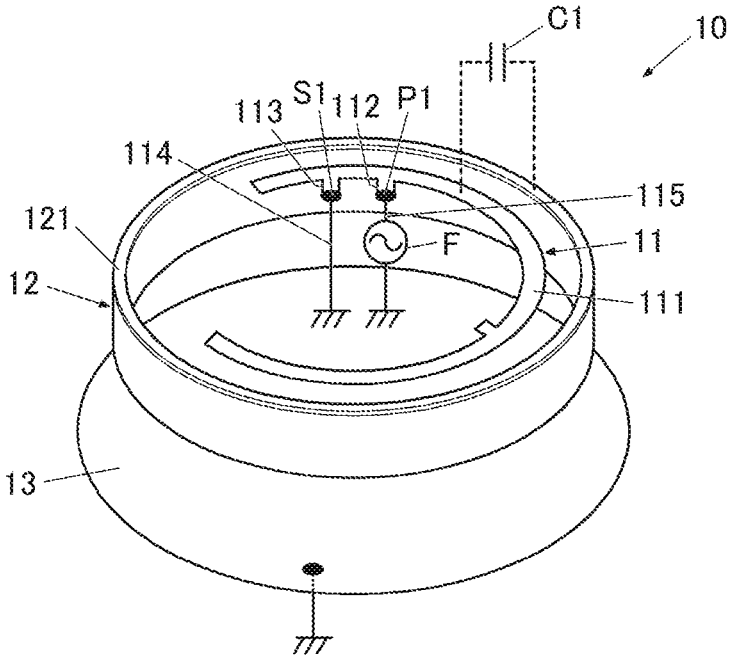
FIG. 1 is a schematic diagram illustrating an antenna device of an embodiment.

Hereinafter, with reference to the accompanying drawings, an embodiment and first to seventh modifications will be sequentially described in detail. However, the present invention is not limited to examples shown in the drawings.

Embodiment

With reference to FIG. 1 to FIG. 5, an embodiment will be described. First, with reference to FIG. 1, an antenna device 10 which can be mounted on an electronic timepiece 1 which is a wristwatch type electronic device of the present embodiment will be described. FIG. 1 is a schematic diagram illustrating the antenna device 10 of the present embodiment.

The electronic timepiece 1 is a digital type wristwatch for acquiring and displaying time using at least radar waves which are GNSS (Global Navigation Satellite System) signals from positioning satellites (GNSS satellites) related to GNSS such as GPS of the United States of America. The antenna device 10 is an antenna device for receiving radar waves which are circularly polarized waves from GNSS satellites. For example, from GPS satellites which are GNSS satellites, right-handed circularly polarized waves of 1.575 GHz are transmitted.

Circularly polarized waves are often used in satellite communication such as satellite broadcasts or GNSS, and are also used in ETC (Electronic Toll Collection System) and so on since they are unlikely to be affected by unnecessary reflection (multi-pass) of radar waves from the surroundings. Unlike linearly polarized waves, the case where an electric field rotates toward the propagation direction is referred to as a circularly polarized wave, and the case where an electric field rotates to the right (clockwise) toward the radio wave propagation direction is referred to as a right-handed circularly polarized wave, and the case where an electric field rotates to the left (counterclockwise) is referred to as a left-handed circularly polarized wave. Although a circularly polarized wave means the case where the magnitude of an electric field which rotates is constant, in an actual antenna, since the magnitude of an electric field does not become constant, it cannot generate a complete circularly-polarized wave, and a polarized wave becomes an ellipsoidal form, and this case is referred to as an elliptically polarized wave.

In an elliptically polarized wave, the ratio of the major axis a and minor axis b of the ellipse is referred to as the axial ratio, and becomes an index indicating how close the trajectory of the polarized wave is to a circle. Also, a bandwidth in which the axial ratio (axial ratio value) becomes 3 dB or less is referred to as an axial ratio bandwidth, and becomes one of performance indexes of a circularly polarized wave. For example, if r is the amplitude of a right-handed circularly polarized wave, and l is the amplitude of a left-handed circularly polarized wave, the axial ratio E is defined by the following Expression 1.

$$\text{Axial Ratio } E=(b/a)=(|r|+|l|)/(|r|-|l|) \quad (1)$$

Here, the direction of one having the larger one of and becomes the rotation direction.

As shown in FIG. 1, the antenna device 10 includes a feed antenna 11, a parasitic antenna 12 which is a metal member, and a ground plate 13. The feed antenna 11 is an antenna element part of an inverted F antenna which is made of a metal (a conductor) such as copper and to which power is fed from a feed unit F, and has antenna elements 111, 112, and 113, and connection parts 114 and 115. The parasitic antenna 12 is an antenna element part which is made of a metal, and is disposed close to the feed antenna 11, and serves as a part of the antenna of the feed antenna 11, and is composed of only an antenna element 121. The ground plate 13 is a metal plate grounded, and serves as a ground.

The antenna element 111 is a C-shaped band-like antenna element which extends along the inner side of the antenna element 121. The antenna elements 112 and 113 are antenna elements which are provided together with the antenna element 111 on the same plane and extend linearly in the direction perpendicular to the extension direction of the antenna element 111. The connection part 114 is a connection part which electrically connects the antenna element 113 and the ground plate 13. A point between the antenna element 113 and the connection part 114 serves as a short circuit point S1. The connection part 115 is a connection part which electrically connects the antenna element 112 and the feed unit F. A point between the antenna element 112 and the connection part 115 serves as a feed point P1. The size of the feed antenna element part 11 is set such that the sum of the length of the antenna element 111 in the extension direction and the length of the connection part 114 corresponds to ¼ of λ, (or ½ of λ) when the wavelength of desired radar waves (radar waves of GNSS signals) is λ.

With an inverted F or inverted L feed element, a small-sized low-profile antenna device can be implemented; however, in general, the performance is likely to be lower than that of a ground type λ/4 monopole antenna. If an antenna is downsized, the input impedance is likely to become small, and in general, the antenna characteristics are likely to deteriorate. Also, the antenna characteristics drastically change according to the influence of the surrounding structures such as electronic components, metal components, and so on provided in the timepiece or in modules.

The inverted F feed antenna element has a structure having a short circuit part (in the feed antenna element unit 11, the connection part 114) which is connected to GND (GrouND), in addition to the inverted F type, and by adjusting various parameters, it is possible to adjust the antenna characteristics to some extent. For example, if the height of the inverted F antenna electric element (or the distance between the antenna element and the ground plate) is changed such that the height of the antenna element becomes lower (the distance becomes shorter), on the Smith chart, the circle becomes larger, and the input impedance decreases, and it becomes difficult to achieve matching. On the contrary, if the height of the inverted F antenna element (the distance between the antenna element and the ground plate) is increased, it is possible to significantly adjust the input impedance, and it is possible to achieve matching.

Also, by adjusting the position of the short circuit point which is connected to the GND of the inverted F antenna element, it is possible to easily perform matching. For example, if the short circuit point is brought closer to the feed point, it is possible to easily perform matching. Also, since if the length of the inverted F antenna element is increased, it is possible to adjust the peak of the return loss characteristic to the low frequency side, it is possible to finely adjust according to a desired signal frequency. Also, since if the length of the inverted F antenna element is decreased, it is possible to adjust the peak to the high frequency side, it is possible to finely adjust according to a desired signal frequency. Also, by increasing the width of the inverted F antenna element or forming the inverted F antenna element in a plate shape, or by increasing the width of a shortening part, on the same principle as that of planar inverted F antennae (PIFA) widely used in portable phone terminals and so on, the small-sized low-profile antenna element can be implemented, and the bandwidth can be widened, and it is possible to increase the shortening rate of the antenna length to the wavelength (since the antenna element tunes to the frequency at which the sum of L (Length) and W (Width) is equal to ¼ of the wavelength λ).

The antenna element 121 is an annular metal antenna element, and serves as a windshield fixing (metal) frame for fixing a windshield 422 to be described below. Further, the antenna element 121 contributes to reinforced waterproofing of the electronic timepiece 1. Also, for the antenna element 121, an elastic steel material such as SUS (Steel Special Use Stainless) can be used. The feed antenna 11 is disposed close to the parasitic antenna 12 (the antenna element 121) with an minute interval (gap) (smaller than about 1 mm or a few mm) so as to be capacitively coupled with the parasitic antenna 12 (for example, such that this coupling is equivalent to the connection via reactance such as a capacitor C1), thereby capable of feeding power in a non-contact manner.

By making the parasitic antenna 12 act as a part of the antenna of the antenna device 10 (the feed antenna 11), it is possible to suppress reception difficulty attributable to the parasitic antenna 12. However, the feed antenna 11 may be configured to be coupled with the parasitic antenna 12 by electromagnetic coupling and feed power to the parasitic antenna in a non-contact manner.

Figure 2:
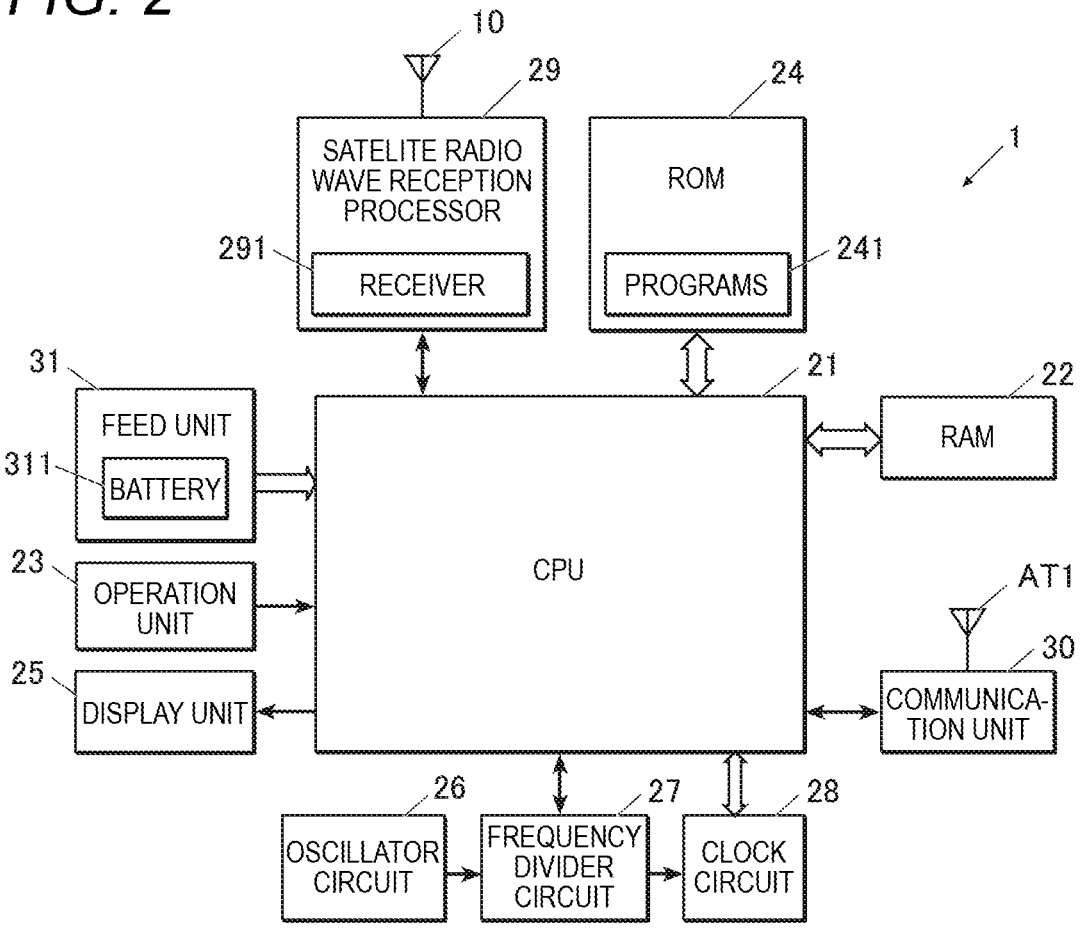
FIG. 2 is a block diagram illustrating the functional configuration of an electronic timepiece of the embodiment.

Now, with reference to FIG. 2, the functional configuration of the inside of the electronic timepiece 1 will be described. FIG. 2 is a block diagram illustrating the functional configuration of the electronic timepiece 1 of the present embodiment.

As shown in FIG. 2, the electronic timepiece 1 includes a CPU (Central Processing Unit) 21, a RAM (Random Access Memory) 22, an operation unit 23, a ROM (Read Only Memory) 24, a display unit 25, an oscillator circuit 26, a frequency divider circuit 27, a clock circuit 28, a satellite radio wave reception processor 29, a communication unit 30, and a feed unit 31.

The CPU 21 performs various calculating processes, and performs control on the operations of the individual units. The CPU 21 performs control processes related to, for example, display operations, notifying operations, and so on based on the results of the positioning operations, date and time acquiring operations, and so on of the satellite radio wave reception processor 29

The RAM 22 provides a memory space for work to the CPU 21, and is a volatile memory, such as a DRAM (Dynamic RAM), for temporarily storing data.

The operation unit 23 receives input operations such as user's operations from the outside. The operation unit 23 has push button switches and so on, and outputs operation signals according to operations of pushing the push button switches to the CPU 21. Alternatively, the operation unit 23 may have touch sensors and the like which are provided on a display panel of the display unit 25.

The ROM 24 stores programs 241 to be executed by the CPU 21, initial setting data, and so on. In the programs 241, control programs related to current date/time acquisition and positioning operations are included. Also, the ROM 24 may have a non-volatile memory such as a flash memory on which rewriting and updating of data is possible, in addition to or in place of a mask ROM.

The display unit 25 performs display of a variety of information on the basis of control of the CPU 21. The display unit 25 has the display panel, a driver circuit (both are not shown in the drawings), and so on. The display panel is, for example, a display panel for performing display by a segment system, or a dot matrix system, or a combination of them, such as an LCD (Liquid Crystal Display), an OLED (Organic Light Emitting Diode), and the like. The driver circuit is a circuit for performing screen display by driving and controlling transmission or light emission of the liquid crystal of the individual pixels of the display panel, on the basis of control of the CPU 21.

The oscillator circuit 26 generates a signal (a clock signal) having a predetermined frequency, herein, for example, 32.768 kHz, and outputs the signal. In generating the clock signal, for example, a crystal oscillator and so on are used. In the frequency of the clock signal which is output from the oscillator circuit 26, an offset error within an allowable range determined in the electronic timepiece 1 can be included. Also, the frequency of the clock signal changes according to the external environment, mainly, temperature.

The frequency divider circuit 27 divides the frequency of the clock signal input from the oscillator circuit 26 at a set frequency division ratio, thereby generating a frequency division signal, and outputs the frequency division signal. The frequency division ratio option can be changed by the CPU 21.

The clock circuit 28 counts and holds current date and time (time and date) by counting signals having a predetermined frequency (which may be the same frequency as that of the clock signal) input from the frequency divider circuit 27. The date/time counting accuracy of the clock circuit 28 depends on the accuracy of the clock signal from the oscillator circuit 26, i.e. the degree of offset error or change mentioned above, and can include an error from the accurate date and time. The CPU 21 can correct the date and time which are counted by the clock circuit 28, on the basis of the current date and time acquired by the satellite radio wave reception processor 29.

The satellite radio wave reception processor 29 is a processing circuit unit which includes the antenna device 10, and can receive transmission radar waves from GNSS satellites via the antenna device 10, and acquires information on the current date and time or the current location by performing a receiving operation of processing received radar waves, and outputs information requested by the CPU 21 in a predetermined format to the CPU 21. The satellite radio wave reception processor 29 includes a receiver 291.

The receiver 291 performs a capturing process of receiving and capturing (detecting) transmission radar waves from GNSS satellites which are reception objects via the antenna device 10 and identifying the GNSS satellites and identifying the phases of signals included in the transmission radar waves (navigation messages), and tracks the transmission radar waves from the GNSS satellites on the basis of the identification information of the GNSS satellites and the phases captured, thereby continuously demodulating and acquiring signals. The receiver 291 is electrically connected to the feed unit F of the antenna device 10.

The communication unit 30 is a circuit unit for bi-directionally performing wireless communication with external devices by a predetermined wireless communication system, thereby performing transmission and reception of information. The communication unit 30 has, for example, an antenna AT1, a signal processing unit, an amplifier, a modulation/demodulation unit, and so on. The communication unit 30 performs signal processing on transmission signals input from the CPU 21 and representing transmission information, thereby amplifying and modulating the transmission signals, and wirelessly transmits the transmission signals from the antenna AT1 to external devices (for example, a smart phone which the user carries), and receives radar waves from external devices by the antenna AT1, and performs demodulation, amplification, and signal processing on the received signals, and outputs the received signals to the CPU 21. As the wireless communication system of the communication unit 30, herein, Bluetooth (registered as a trade mark) is used; however, the present invention is not limited thereto.

The feed unit 31 performs power feeding at a predetermined drive voltage from a battery 311 to each unit of the electronic timepiece 1, such as the CPU 21. As the battery 311, herein, a dry cell, a rechargeable battery, or the like removable is used. However, the feed unit 31 is not limited to this configuration, and may have, for example, a configuration having a solar panel, a chargeable unit (a charge storage unit), and so on.

Figure 3:
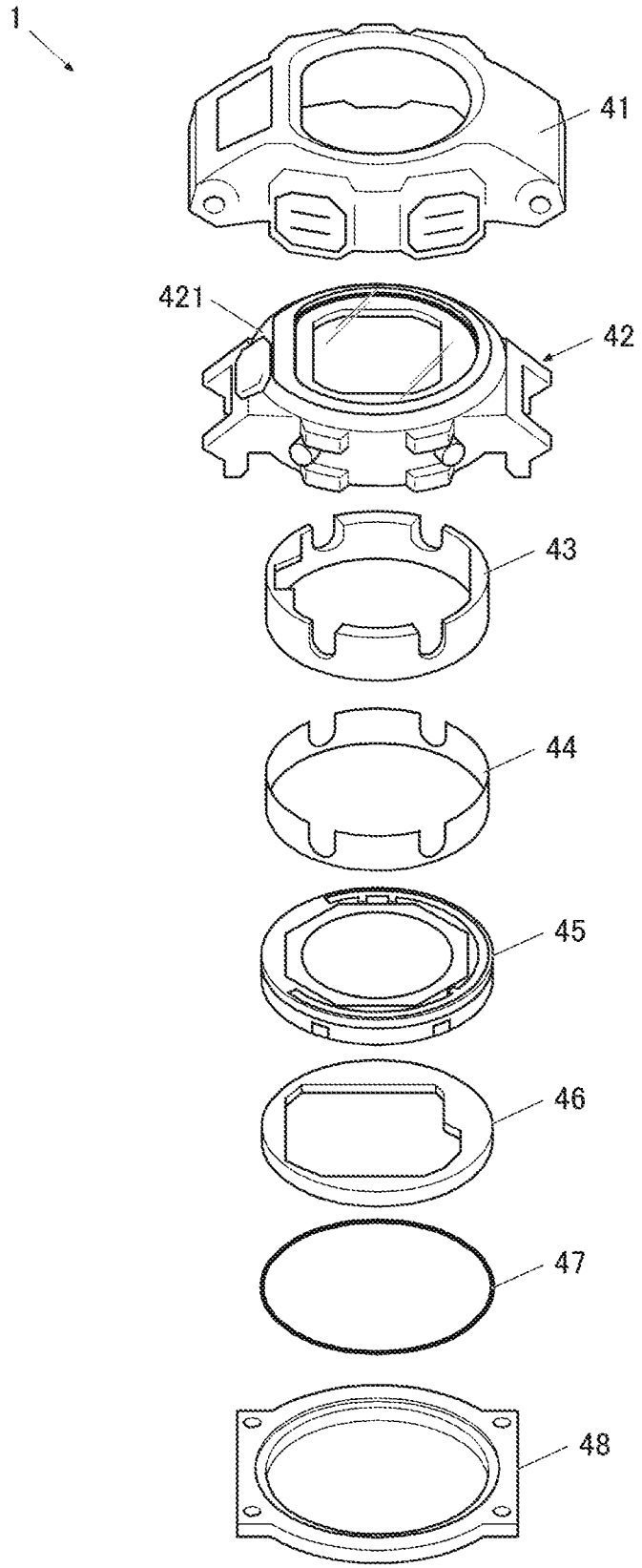
FIG. 3 is an exploded view of individual components of the electronic timepiece of the embodiment.
Figure 4A:
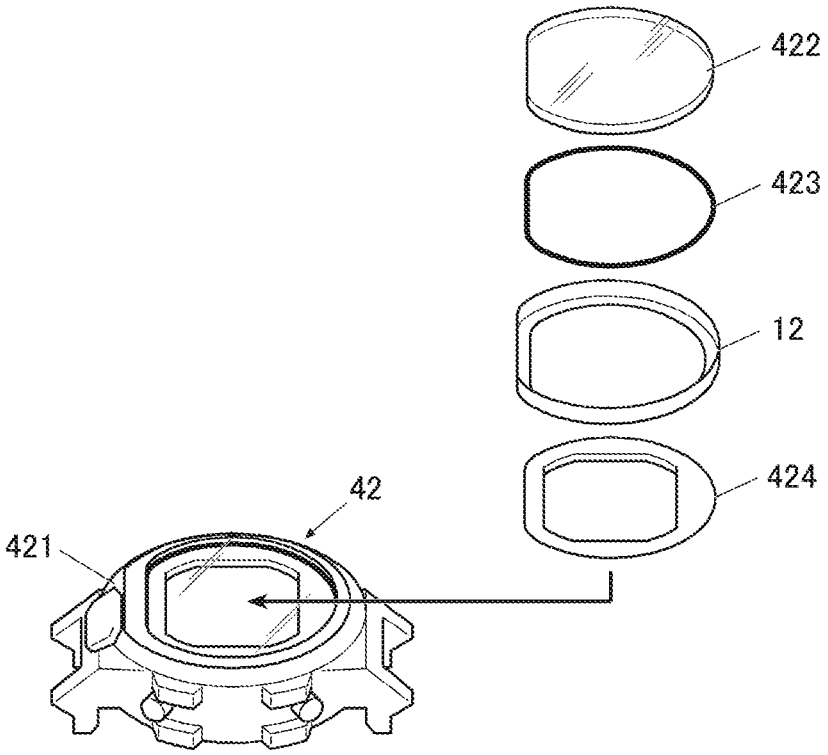
FIG. 4A is an exploded view of individual components of a side case part.
Figure 4B:
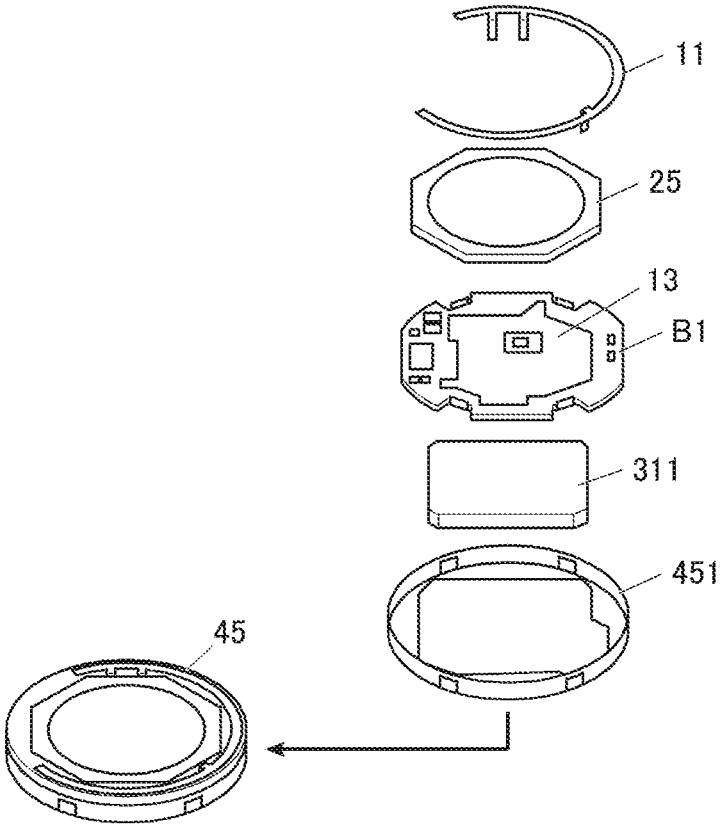
FIG. 4B is an exploded view of individual components of an electronic circuit module.
Figure 5:
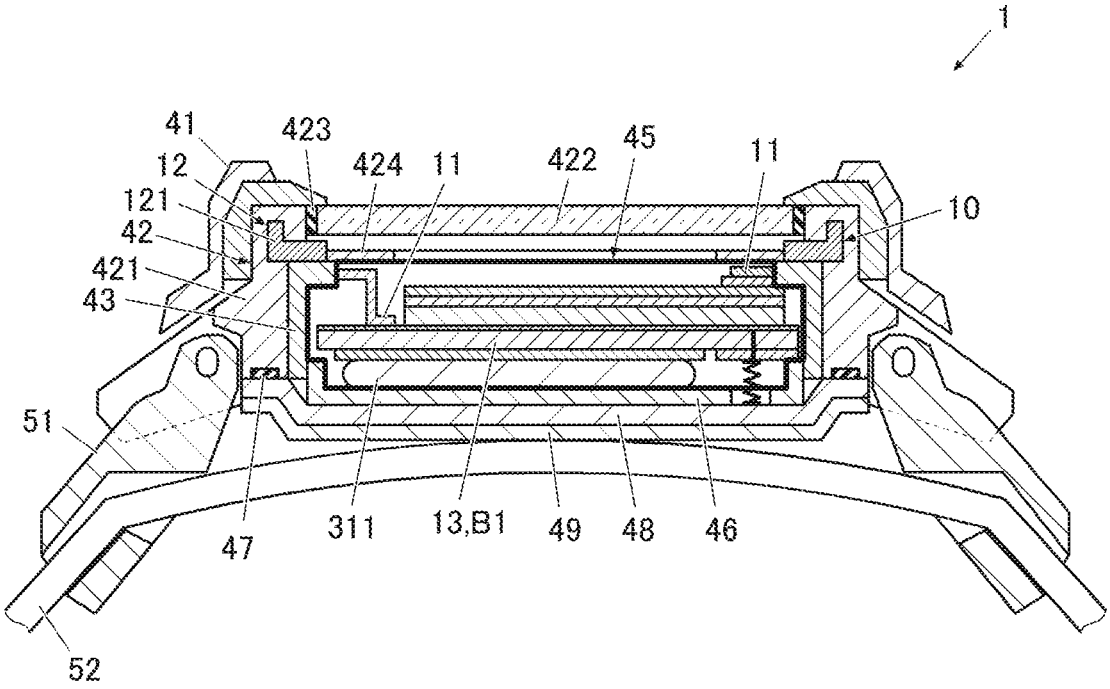
FIG. 5 is a cross-sectional view of the electronic timepiece of the embodiment.

Now, with reference to FIG. 3 to FIG. 5, individual components of the electronic timepiece 1 and the configurations thereof will be described. FIG. 3 is an exploded view of individual components of the electronic timepiece 1 of the present embodiment. FIG. 4A is an exploded view of individual components of a side case part 42. FIG. 4B is an exploded view of individual components of an electronic circuit module 45. FIG. 5 is a cross-sectional view of the electronic timepiece 1 of the present embodiment.

As shown in FIG. 3, the electronic timepiece 1 sequentially includes a bezel 41, the side case part 42, a side buffer ring 43, an interior cover 44, the electronic circuit module 45, a bottom buffer unit 46, a waterproof packing 47, and a rear lid back 48 spread out from the top to the bottom. These components are assembled, whereby the electronic timepiece 1 is configured.

The bezel 41 is a component which is made of a material such as urethane resin, and absorbs impact from the outside, thereby protecting the internal components of the electronic timepiece 1. The side case part 42 is a case part for supporting and storing the windshield 422 and so on.

As shown in FIG. 3 and FIG. 4A, the side case part 42 sequentially includes a side case 421, and the windshield 422, a waterproof packing 423, a parasitic antenna element part 12, and a window parting unit 424 spread out from the top to the bottom. The side case 421 is made of a material such as a reinforced resin, and supports the windshield 422, the waterproof packing 423, and the window parting unit 424, and supports and stores the electronic circuit module 45. Also, as shown in FIG. 5, in the side case 421, the parasitic antenna element part 12 is formed by insert molding. In other words, in the mold of the side case 421, the parasitic antenna 12 is inserted, and a reinforced resin in a liquid state is injected and is cooled, whereby the side case 421 with the parasitic antenna 12 integrated is formed.

By using the parasitic antenna 12 formed inside the side case 421 by insert molding as a metal window frame (windshield fixing frame), it is possible to secure reinforced waterproof performance (equal to or higher than waterproof performance up to 10 to 20 atm), impact resistance, and robustness in the electronic timepiece 1.

The windshield 422 is a glass plate which prevents entry of wind, water, dust, and the like from the outside into the electronic circuit module 45 and so on provided in the electronic timepiece 1 and transmits display information of the display unit 25. The waterproof packing 423 is made of an elastic material such as rubber and the like, and is disposed, pinched, and deformed between the windshield 422 and the side case 421, thereby preventing entry of water, dust, and the like from the outside into the electronic circuit module 45 and so on provided in the electronic timepiece 1. The window parting unit 424 is a plate-shaped component for covering the display panel of the display unit 25 and determining the parting shape.

The side buffer ring 43 is a ring-shaped component which is made of a material such as a resin, a synthetic rubber, or the like, and is disposed between the side surface of the electronic circuit module 45 and the side case 421, thereby alleviating interference between the two components and preventing damage. The interior cover 44 is a ring-shaped component which is made of a material such as a resin, and fixes the side buffer ring 43.

As shown in FIG. 4B, the electronic circuit module 45 sequentially includes the feed antenna 11, the display unit 25, an electronic circuit board B1, the battery 311 (the feed unit 31), and a housing member 451 spread out from the top to the bottom. The electronic circuit board B1 is a board having the ground plate 13, the CPU 21, the RAM 22, the operation unit 23, the ROM 24, the oscillator circuit 26, the frequency divider circuit 27, the clock circuit 28, the satellite radio wave reception processor 29 except the feed antenna 11 and the parasitic antenna 12, and the communication unit 30, as an electronic circuit.

The ground plate 13 has a configuration using metal foil on the board of the electronic circuit board B1, as a ground plate (GND), but is not limited thereto. For example, the ground plate 13 may have a configuration using an electromagnetic shield plate or ground plate provided in the electronic circuit module 45, as a ground plate. The housing member 451 is a member for storing the feed antenna 11, the display unit 25, the electronic circuit board B1, and the battery 311.

The bottom buffer unit 46 is a component which is made of a material such as a resin or a synthetic rubber, and is disposed between the bottom of the electronic circuit module 45 and the rear lid back 48, thereby alleviating interference between the two components and preventing damage. The waterproof packing 47 is made of an elastic material such as rubber and the like, and is disposed, pinched, and deformed between the windshield 422 and the rear lid back 48, thereby preventing entry of water, dust, and the like from the outside into the electronic circuit module 45 and so on provided in the electronic timepiece 1.

The rear lid back 48 is a cover unit for covering the electronic circuit module 45 and so on provided in the electronic timepiece 1, from below (the rear side). Further, as shown in FIG. 5, the electronic timepiece 1 includes a back cover 49, band mounting parts 51, and a band 52.

The back cover 49 is a cover unit which is made of a material such as a resin, and covers the rear lid back 48 from below (the rear side). The band mounting parts 51 are components which are connected to the side case part 42, and are for mounting the band 52. The band 52 is made of a material such as a resin, fabric, a metal, and the like, and is a band part for winding and fixing the electronic timepiece 1 on a wrist of the user or the like.

As described above, according to the present embodiment, the antenna device 10 includes the parasitic antenna 12 which is a metal member which is used as the windshield fixing frame of the wristwatch type electronic device, and the feed antenna 11 which is a conductor. The parasitic antenna 12 has an annular shape, and is disposed close to the feed antenna 11, and is electromagnetically or capacitively coupled with the feed antenna 11, thereby receiving power from the feed antenna 11 in a non-contact manner, and acts as a loop type parasitic antenna element, and the antenna device 10 acts as a circular polarized antenna for receiving radar waves which are circularly polarized waves having a predetermined wavelength by the actions of the feed antenna 11 and the loop type parasitic antenna element which is the parasitic antenna 12.

Therefore, since the parasitic antenna 12 which is a metal member functions as a part of the antenna device 10 (the feed antenna 11), it is possible to suppress reception difficulty, and the antenna device 10 can have high communication performance (high reception performance for GNSS signals). Also, since power feeding is performed in a non-contact manner in the state where the feed antenna 11 and the parasitic antenna 12 are close, direct connection with an antenna on an exterior case, wiring, and the like become unnecessary, and it is possible to simplify the structure of the antenna device 10. Further, without changing the internal module configuration of the electronic timepiece 1, it becomes easy to perform insert molding of the case, and include metal members, and change or alter the exterior design or shape, materials, and so on, and it is possible to diversify the timepiece design and decorativeness, and improve the degree of freedom of design of the antenna device 10.

Also, the parasitic antenna 12 acts as a loop type parasitic antenna element formed in the side case part 42 for storing the antenna device 10 by insert molding. Therefore, in the electronic timepiece 1 having the exterior appearance like a case made of a resin and a metal by insert molding, it is possible to widen the diversity of the exterior appearance design and style of the product without lowering the exterior performance such as reinforced waterproof performance, impact resistance, and so on.

Also, the feed antenna 11 is provided in the electronic circuit module 45 disposed inside the parasitic antenna 12 and below the windshield 422. Therefore, it is possible to make the antenna device 10 and the electronic timepiece 1 compact.

Also, the feed antenna 11 is an inverted F antenna element part, and includes the antenna element 111 extending linearly, and the antenna element 113 which is short-circuited and the antenna element 112 which receives power, sequentially disposed on one end side of the antenna element 111 in the extension direction. Therefore, it is possible to make the feed antenna 11 act as an inverted F antenna.

Also, the parasitic antenna 12 is characterized by being made of an elastic material and being used for reinforced waterproofing. Therefore, it is possible to further improve the reinforced waterproof performance of the electronic timepiece 1.

Also, the electronic timepiece 1 includes the antenna device 10. Therefore, in the configuration having the parasitic antenna element part 12 which is a metal member, it is possible to have high communication performance by the antenna device 10. Also, for this reason, it is possible to simplify the structure of the antenna device 10. Also, for this reason, while it is possible to improve the degree of freedom of design of the antenna device 10, it is possible to implement the electronic timepiece 1 superior in reinforced waterproof performance, impact resistance, robustness, and so on by the parasitic antenna element part 12.

(First Modification)

Figure 6A:
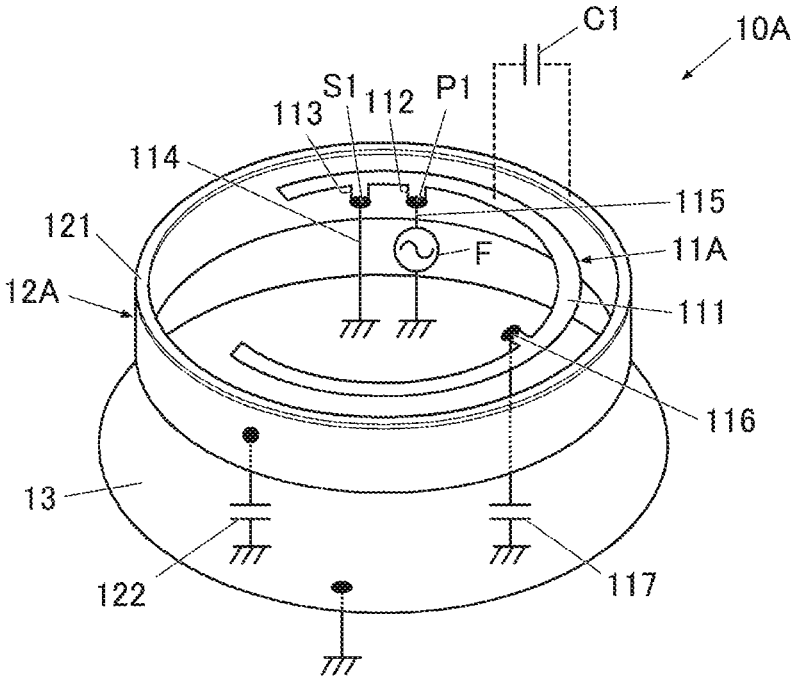
FIG. 6A is a schematic diagram illustrating a first antenna device of a first modification.
Figure 6B:
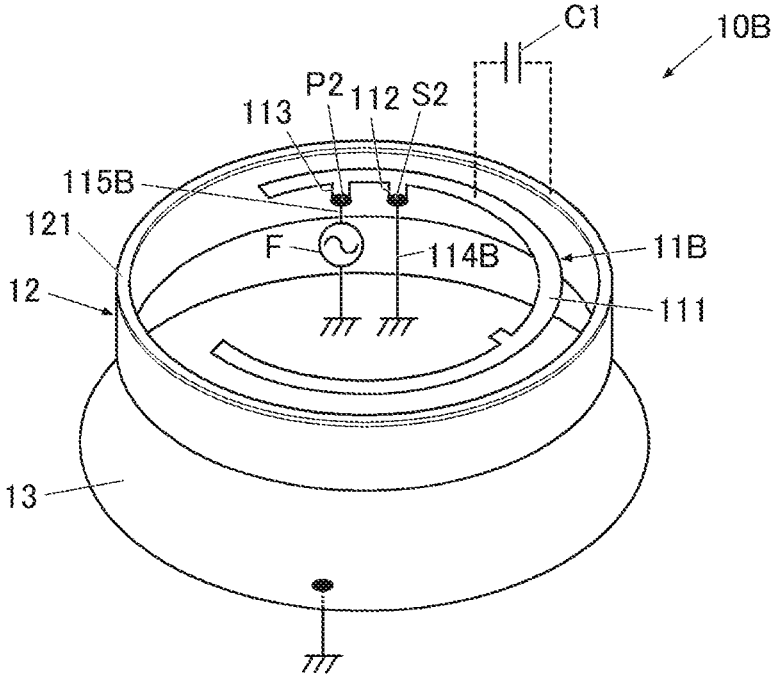
FIG. 6B is a schematic diagram illustrating a second antenna device of the first modification.

With reference to FIG. 6A and FIG. 6B, a first modification of the above-described embodiment will be described. FIG. 6A is a schematic diagram illustrating an antenna device 10A of the present modification. FIG. 6B is a schematic diagram illustrating an antenna device 10B of the present modification.

In the present modification, configurations in which the antenna device 10A or 10B substitutes for the antenna device 10 of the electronic timepiece 1 of the above-described embodiment are taken. Therefore, different parts will be mainly described.

As shown in FIG. 6A, the antenna device 10A has a configuration in which a feed antenna 11A and a parasitic antenna 12A substitute for the feed antenna 11 and the parasitic antenna 12 of the antenna device 10. The feed antenna 11A has a configuration including a connection part 116 and a capacitor 117 in addition to the feed antenna 11. The connection part 116 is, for example, a connection part disposed in the vicinity of the center of the antenna element 111 in the extension direction. The connection part 116 of the antenna element 111 and the ground plate 13 are electrically connected via the capacitor 117. Also, the parasitic antenna 12A has a configuration having a capacitor 122 in addition to the parasitic antenna 12. The antenna element 121 and the ground plate 13 are electrically connected via the capacitor 122.

As shown in FIG. 6B, the antenna device 10B has a configuration in which a feed antenna 11B substitutes for the feed antenna 11 of the antenna device 10. The feed antenna 11B has a configuration in which connection parts 114B and 115B substitute for the connection parts 114 and 115. The connection part 114B is a connection part which electrically connects the antenna element 112 and the ground plate 13. A point between the antenna element 112 and the connection part 114B serves as a short circuit point S2. The connection part 115B is a connection part which electrically connects the antenna element 113 and the feed unit F. A point between the antenna element 113 and the connection part 115B serves as a feed point P2. The size of the feed antenna element part 11B is set such that the sum of the length of the antenna element 111 in the extension direction and the length of the connection part 114B corresponds to ¼ of λ, (or ½ of k) when the wavelength of desired radar waves is λ.

Therefore, according to the antenna device 10A of the present modification, in the feed antenna 11A, the antenna element 111 has the connection part 116 unlike the antenna element 113, and the connection part 116 is grounded via the capacitor 117. For this reason, similarly to the antenna device 10, in the configuration having the parasitic antenna 12A which is a metal member, it is possible to have high communication performance, and it is possible to simplify the structure of the antenna device 10A, and it is possible to improve the degree of freedom of design of the antenna device 10A.

Also, according to the antenna device 10B of the present modification, the feed antenna 11A is an inverted F antenna element part, and includes the antenna element 111 extending linearly, and the antenna element 113 to which power is fed and the antenna element 112 which is short-circuited, sequentially disposed on one end side of the antenna element 111 in the extension direction. Therefore, similarly to the antenna device 10, in the configuration having the parasitic antenna 12 which is a metal member, it is possible to have high communication performance, and it is possible to simplify the structure of the antenna device 10B, and it is possible to improve the degree of freedom of design of the antenna device 10B.

(Second Modification)

Figure 7:
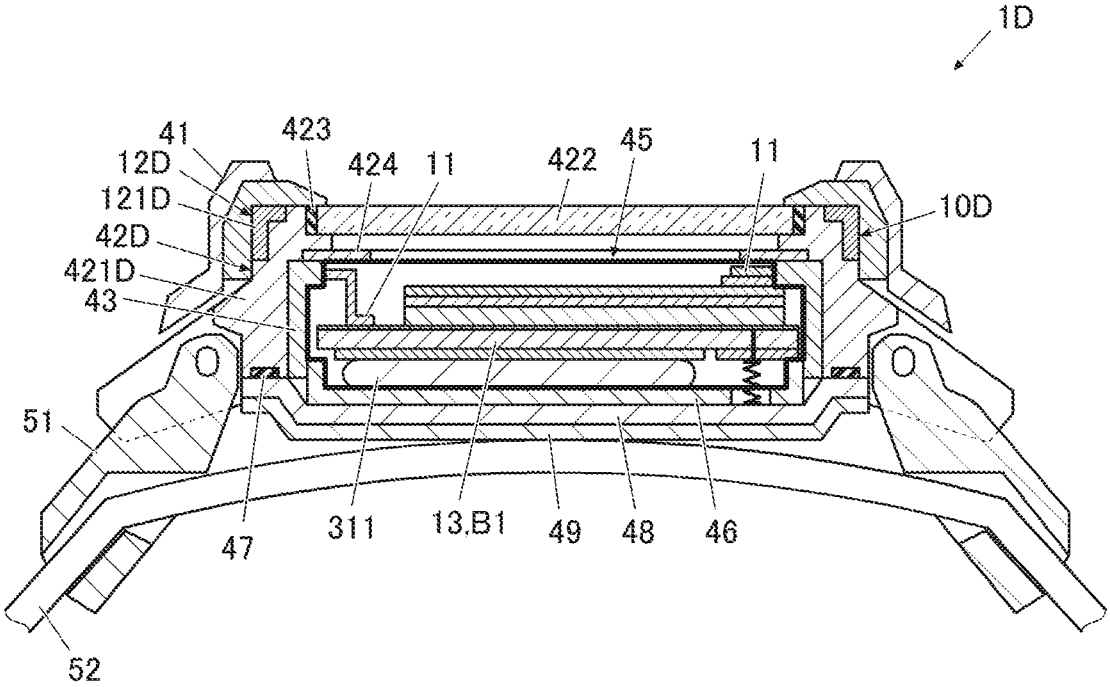
FIG. 7 is a cross-sectional view illustrating a first electronic timepiece of a second modification.
Figure 8:
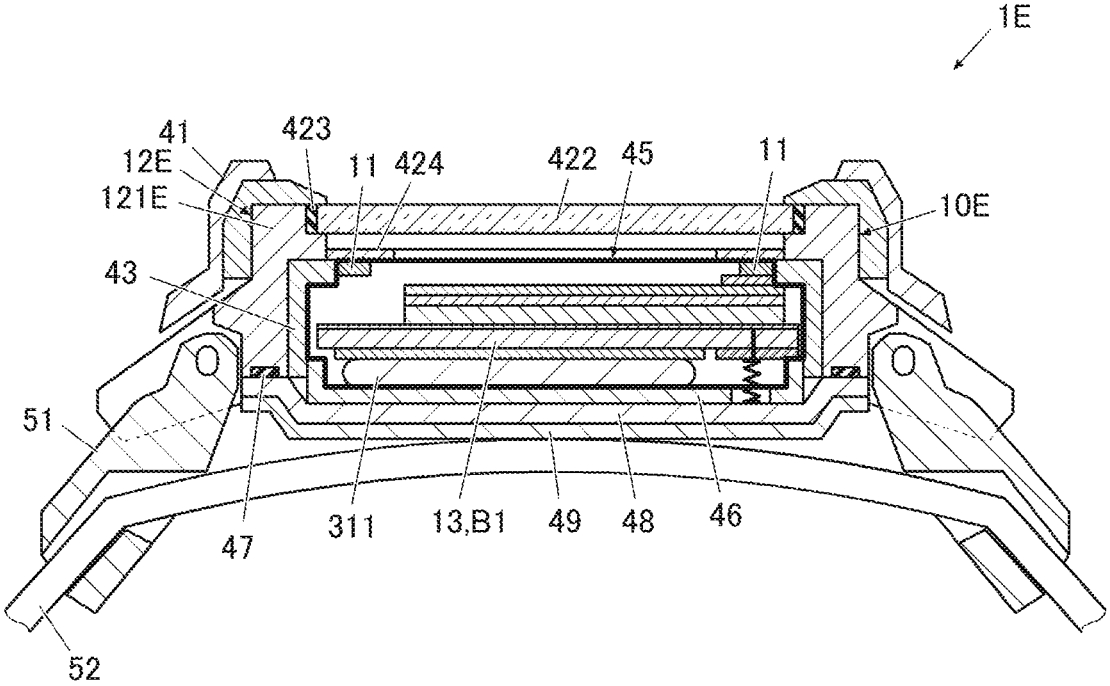
FIG. 8 is a cross-sectional view illustrating a second electronic timepiece of the second modification.

With reference to FIG. 7 and FIG. 8, a second modification of the above-described embodiment will be described. FIG. 7 is a cross-sectional view illustrating an electronic timepiece 1D of the present modification. FIG. 8 is a cross-sectional view illustrating an electronic timepiece 1E of the present modification.

In the present modification, configurations in which the electronic timepiece 1D or 1E substitutes for the electronic timepiece 1 of the above-described embodiment are taken. Therefore, different parts will be mainly described.

As shown in FIG. 7, the electronic timepiece 1D has an antenna device 10D in place of the antenna device 10 of the electronic timepiece 1. The antenna device 10D has a configuration in which an antenna element 121D of a parasitic antenna 12D and a side case 421D of a side case part 42D substitute for the antenna element 121 of the parasitic antenna 12 and the side case 421 of the side case part 42 included in the antenna device 10. The antenna element 121D is an annular parasitic antenna made of a metal on the side case 421D by outsert molding. The antenna element 121D acts as a part of the antenna of the antenna device 10D (the feed antenna 11), and also serves as a glass fixing metal frame for fixing the windshield 422.

The side case 421D is made of a material such as a reinforced resin, and supports the windshield 422, the waterproof packing 423, and the window parting unit 424, and supports and stores the electronic circuit module 45. Also, on the side case 421D, a parasitic antenna element part 12D is formed by outsert molding. In other words, a reinforced resin in a liquid state is injected into the mold of the side case 421D, and is cooled, whereby the resin part of the side case 421D is formed, and on the outer side of the resin part of the side case 421D formed, the parasitic antenna 12D is integrally attached.

As shown in FIG. 8, the electronic timepiece 1E has an antenna device 10E in place of the antenna device 10 of the electronic timepiece 1. The antenna device 10E has a configuration in which one antenna element 121E of a parasitic antenna 12E substitutes for the antenna element 121 of the parasitic antenna 12 and the side case 421 of the side case part 42 provided in the antenna device 10. The antenna element 121E is a parasitic antenna which is a metal member, and acts as a part of the antenna of the antenna device 10E (the feed antenna 11). The antenna element 121E also serves as a glass fixing metal frame for fixing the windshield 422, and also serves as a side case for supporting the waterproof packing 423 and the window parting unit 424 and supporting and storing the electronic circuit module 45.

As described above, according to the antenna device 10D, the parasitic antenna 12D acts as a loop type parasitic antenna formed on the side case 421D for storing the antenna device 10A by outsert molding. Therefore, in the electronic timepiece 1D having the exterior appearance like a case made of a resin and a metal by outsert molding, it is possible to widen the diversity of the exterior appearance design and style of the product without lowering the exterior performance such as reinforced waterproof performance, impact resistance, and so on.

Also, according to the antenna device 10E, the parasitic antenna 12E acts as a loop type parasitic antenna which is a side case part for storing the antenna device 10B. Therefore, in the impact-resistant electronic timepiece 1E which has reinforced metallic appearance, gloss, and the like since it uses members such as the side buffer ring 43 and so on having high impact absorbing property and high impact buffing property in terms of the contents of the exterior although it uses a metal member on the outside, by using the parasitic antenna 12E made of a metal such as stainless or titanium as the case exterior, it is possible to widen the diversity of design of the exterior appearances of products, such as timepiece designs for business and for daily use.

(Third Modification)

Figure 9:
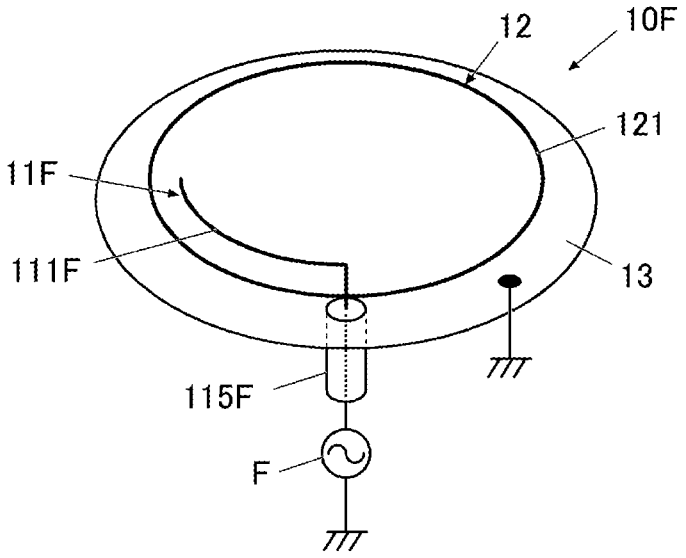
FIG. 9 is a schematic diagram illustrating an antenna device of a third modification.

With reference to FIG. 9, a third modification of the above-described embodiment will be described. FIG. 9 is a schematic diagram illustrating an antenna device 10F of the present modification.

In the present modification, a configuration in which the antenna device 10F substitutes for the antenna device 10 of the electronic timepiece 1 of the above-described embodiment is taken. Therefore, different parts will be mainly described.

As shown in FIG. 9, the antenna device 10F includes a feed antenna 11F and the parasitic antenna 12. The feed antenna 11F includes an antenna element 111F and a connection part 115F. The antenna element 111F is a C-shaped antenna element which is disposed inside the parasitic antenna 12 and is made of a metal such as copper, and acts as an inverted L antenna element. The connection part 115F is a connection part made of a metal, and electrically connects the antenna element 111F and the feed unit F.

As described above, according to the antenna device 10F of the present modification, the feed antenna 11F is an inverted L antenna element part. Therefore, it is possible to make the feed antenna 11 act as an inverted L antenna. Although the inverted L antenna has performance lower than that of inverted F antennae, it can have a low profile, and the configuration of a feed element can be simplified. Also, the performance of the inverted L antenna lowers as the part bent at 90 approaches the feed point. Also, since the impedance of the inverted L antenna significantly deviates from 50 Ω, matching is necessary.

(Fourth Modification)

Figure 10A:
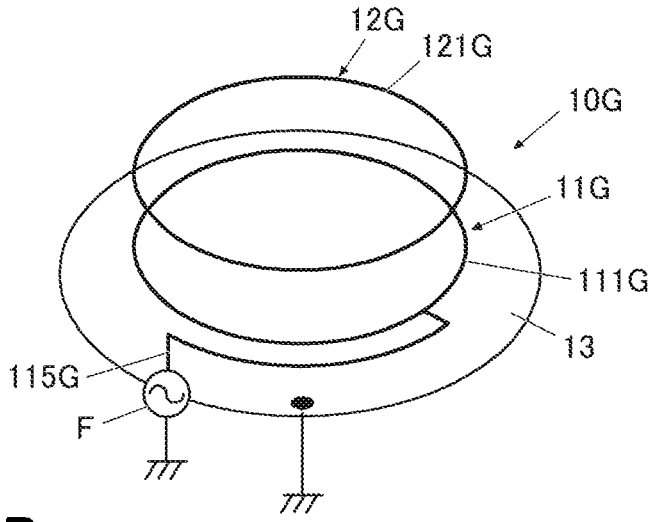
FIG. 10A is a schematic diagram illustrating a first antenna device of a fourth modification.
Figure 10B:
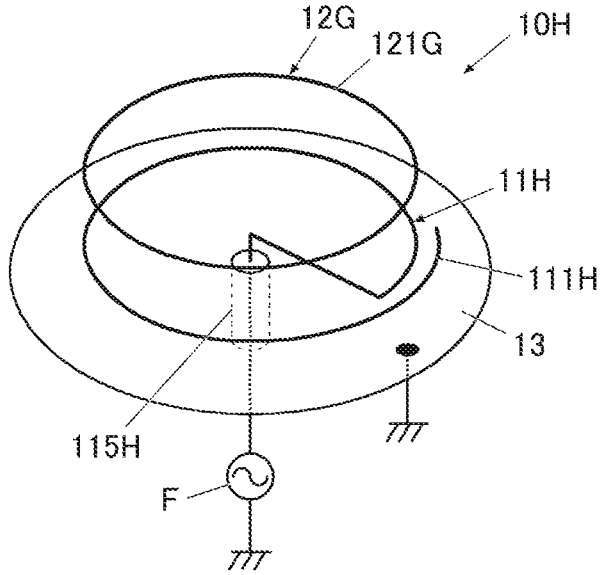
FIG. 10B is a schematic diagram illustrating a second antenna device of the fourth modification.
Figure 10C:
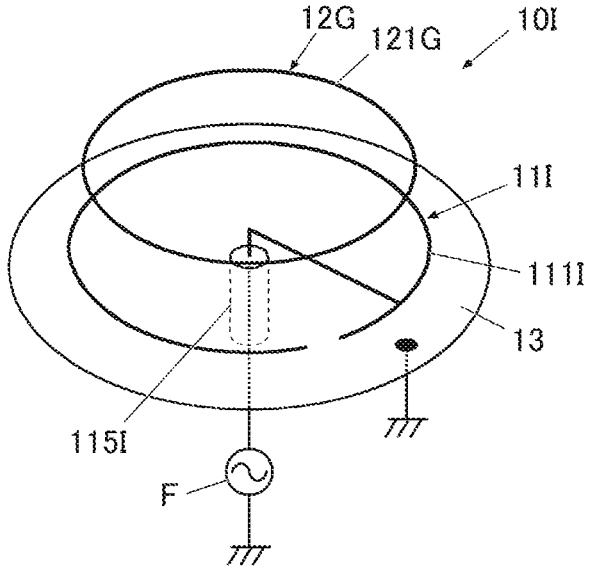
FIG. 10C is a schematic diagram illustrating a third antenna device of the fourth modification.

With reference to FIG. 10A to FIG. 10C, a fourth modification of the above-described embodiment will be described. FIG. 10A is a schematic diagram illustrating an antenna device 10G of the present modification. FIG. 10B is a schematic diagram illustrating an antenna device 10H of the present modification. FIG. 10C is a schematic diagram illustrating an antenna device 10I of the present modification.

In the present modification, configurations in which the antenna device 10G, 10H, or 10I substitutes for the antenna device 10 of the electronic timepiece 1 of the above-described embodiment are taken. Therefore, different parts will be mainly described.

As shown in FIG. 10A, the antenna device 10G includes a feed antenna 11G and a parasitic antenna 12G The feed antenna 11G includes an antenna element 111G and a connection part 115G The parasitic antenna 12G includes an antenna element 121G The antenna element 111G is made of a metal such as copper and is an annular antenna element disposed at a predetermined distance below the plane of the antenna element 111G in parallel. It is assumed that the perimeter of the antenna element 111G is about the wavelength λ of desired radar waves.

Also, the antenna element 121G is an antenna element which has an annular wave guide loop shape having a perimeter (such as 0.95λ) slightly shorter than about the wavelenth λ of desired radar waves, and is disposed at a predetermined distance, such as about a distance corresponding to ½ of the wavelenth λ of desired radar waves or a distance corresponding to 0.45 times the wavelength, from the antenna element 111G in the radial direction. Therefore, as the antenna device 10G, a circular polarized loop antenna having a high gain and a simple structure can be configured.

The antenna element 111G is connected to the connection part 115G The connection part 115G is made of a metal like the antenna element 111G and is formed in a shape in which one end in the periphery is connected to the antenna element 111G and the other end extends along the radial-loop-shaped antenna element over about a distance corresponding to ¼ of the wavelenth λ of desired radar waves, and is electrically connected to the feed unit F, thereby serving as a feed terminal.

As shown in FIG. 10B, the antenna device 10H includes a feed antenna 11H and the parasitic antenna 12G The feed antenna 11H includes an antenna element 111H and a connection part 115H. The antenna element 111H is a spiral antenna element made of a metal such as copper and disposed at a predetermined distance below the plane of the antenna element 111G in parallel, and the perimeter and arrangement thereof is the same as those of the antenna element 111G The connection part 115H is made of a metal like the antenna element 111G and one end thereof is connected to the antenna element 111H and the other end is electrically connected to the feed unit F, thereby serving a feed terminal.

As shown in FIG. 10C, the antenna device 10I includes a feed antenna 11I and the parasitic antenna 12G The feed antenna 11I includes an antenna element 111I and a connection part 115I. The antenna element 111I is a C-shaped antenna element made of a metal such as copper and disposed at a predetermined distance below the plane of the antenna element 111G in parallel, and the perimeter and arrangement thereof is the same as those of the antenna element 111G The connection part 115I is made of a metal like the antenna element 111I, and one end thereof is connected to the antenna element 111I and the other end is electrically connected to the feed unit F, thereby serving a feed terminal.

As described above, according to the antenna device 10G of the present modification, the feed antenna 11G has the annular antenna element 111G disposed at the predetermined distance from the parasitic antenna 12G in parallel. Therefore, similarly to the antenna device 10, in the configuration having the parasitic antenna 12G which is a metal member, it is possible to have high communication performance, and it is possible to simplify the structure of the antenna device 10G, and it is possible to improve the degree of freedom of design of the antenna device 10G.

Also, according to the antenna device 10H of the present modification, the feed antenna 11H has the spiral antenna element 111H disposed at the predetermined distance from the parasitic antenna 12G in parallel. For this reason, similarly to the antenna device 10, in the configuration having the parasitic antenna 12G which is a metal member, it is possible to have high communication performance, and it is possible to simplify the structure of the antenna device 10H, and it is possible to improve the degree of freedom of design of the antenna device 10H.

Also, according to the antenna device 10I of the present modification, the feed antenna 11I has the C-shaped antenna element 111I disposed at the predetermined distance from the parasitic antenna 12G in parallel. For this reason, similarly to the antenna device 10, in the configuration having the parasitic antenna 12G which is a metal member, it is possible to have high communication performance, and it is possible to simplify the structure of the antenna device 10I, and it is possible to improve the degree of freedom of design of the antenna device 10I.

Also, the parasitic antenna 12G has a perimeter shorter than the length of the antenna element 111G, 111H, or 111I in the extension direction by a predetermined length. Therefore, in the antenna devices 10G, 11H, and 10I, it is possible to configure a circular polarized loop antenna having a high gain and a simple structure, and in the case of obtaining a desired gain relative to desired communication signals such as radar waves which are GNSS signals, it is possible to configure a small-sized circular polarized antenna having a simple structure.

(Fifth Modification)

Figure 11:
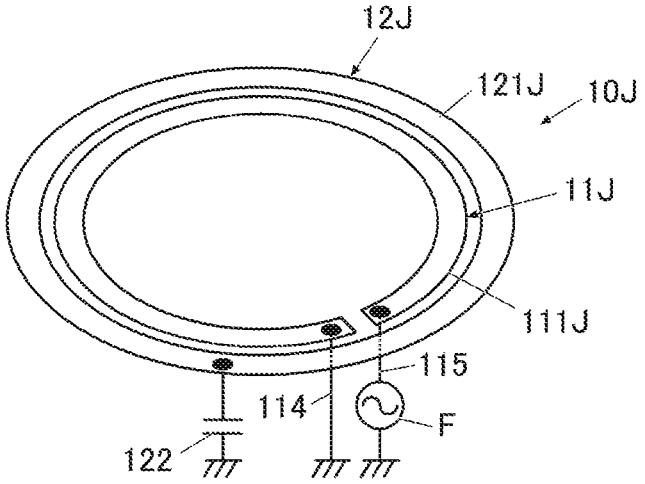
FIG. 11 is a schematic diagram illustrating an antenna device of a fifth modification.

With reference to FIG. 11, a fifth modification of the above-described embodiment will be described. FIG. 11 is a schematic diagram illustrating an antenna device 10J of the present modification.

In the present modification, a configuration in which the antenna device 10J substitutes for the antenna device 10 of the electronic timepiece 1 of the above-described embodiment is taken. Therefore, different parts will be mainly described.

As shown in FIG. 11, the antenna device 10J includes a feed antenna 11J and a parasitic antenna 12J. The feed antenna 11J includes an antenna element 111J and the connection parts 114 and 115. The parasitic antenna 12J includes an antenna element 121J.

The antenna element 111J is an annular line antenna element made of a metal such as copper, and disposed close to the antenna element 121J on the same plane, and having a C shape, and having a predetermined width based on characteristic impedance. It is assumed that the perimeter of the antenna element 111J is about the wavelength λ1 of desired radar waves. One end of the connection part 114 is electrically connected to one end of the antenna element 111J, and the other end is grounded (electrically connected to the ground plate 13). One end of the connection part 115 is connected to the antenna element 111J, and the other end is electrically connected to the feed unit F, thereby serving a feed terminal. Like this, one end of the antenna element 111J is electrically connected to the connection part 114, and the other end is electrically connected to the connection part 115.

The antenna element 121J is made of a metal, and is disposed on the outer side from the outer periphery of the antenna element 111J in the radial direction, and is formed in an annular line along the antenna element 111J with a predetermined gap. The antenna element 111J is grounded (electrically connected to the ground plate 13) via the capacitor 122. The perimeter of the antenna element 121J is set to a length corresponding to a wavelength λ2 corresponding to a specific frequency f2 slightly different from a specific frequency f1 corresponding to the desired radar wave wavelength λ1 of the antenna element 111J.

In the case where a signal is transmitted from the feed point toward the matching termination along the antenna element 111J which is a feed electrode pattern, since there is a difference in current path length between the antenna element 111J at the inner periphery and the antenna element 121J at the outer periphery, a magnetic current source is generated, and an electromagnetic wave is radiated. In the case where one wavelength of a signal to which power is fed is equal to the length of the antenna element 111J, since the cycle of the electromagnetic wave and the rotation cycle of the electric field vector are the same, the signal becomes a circularly polarized wave. Further, since the antenna element 121J which is a parasitic electrode pattern is electromagnetically coupled (capacitively coupled) with the antenna element 111J, from this, similarly, an electromagnetic wave is radiated. This electromagnetic wave becomes a circularly polarized wave when one wavelength of the signal to which power is fed and the perimeter of the antenna element 121J become equal.

Since the perimeter of the antenna element 121J is slightly longer than the length of the antenna element 111J, from the antenna element 121J, a circularly polarized wave having a wavelength longer than the length of the antenna element 111J is radiated. Therefore, in the antenna device 10J, it is possible to implement a circular polarized antenna having a wide gain bandwidth and capable of radiating and receiving circularly polarized waves having a wide axial ratio bandwidth.

As described above, according to the antenna device 10J of the present modification, the feed antenna 11J includes the C-shaped antenna element on the inner side on the same plane with the parasitic antenna 12J. The perimeter of the antenna element 121J is longer than the length of the antenna element 111J in the extension direction by a predetermined length. For this reason, similarly to the antenna device 10, in the configuration having the parasitic antenna 12J which is a metal member, it is possible to have high communication performance, and it is possible to simplify the structure of the antenna device 10J, and it is possible to improve the degree of freedom of design of the antenna device 10J. Also, it is possible to implement the antenna device 10J which is a circular polarized antenna having a wide gain bandwidth and capable of radiating and receiving circularly polarized waves having a wide axial ratio bandwidth.

(Sixth Modification)

Figure 12A:
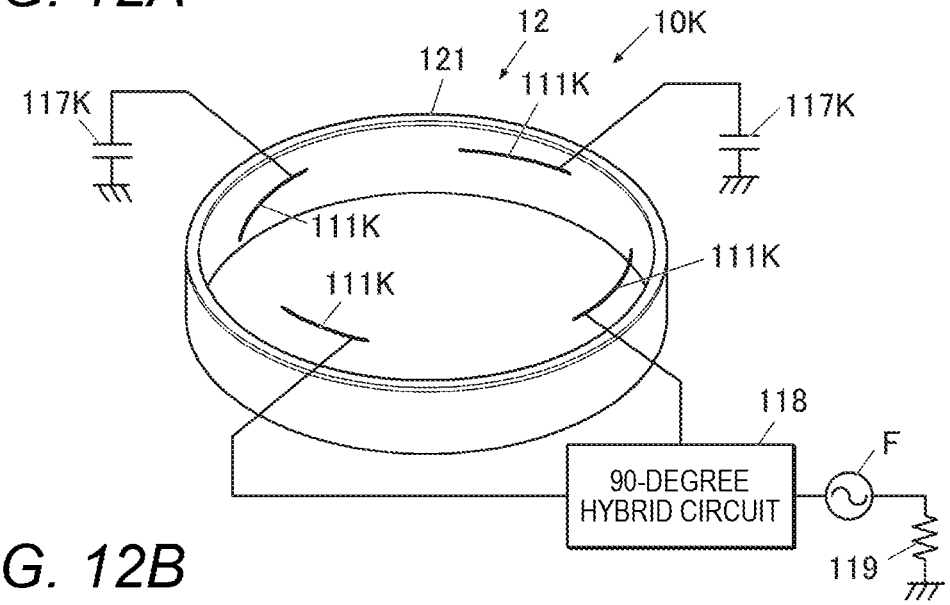
FIG. 12A is a schematic diagram illustrating a first antenna device of a sixth modification.
Figure 12B:
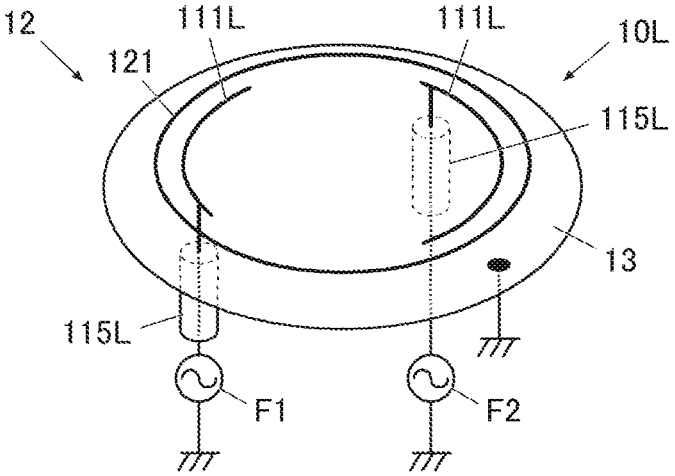
FIG. 12B is a schematic diagram illustrating a second antenna device of the sixth modification.

With reference to FIG. 12A to FIG. 12B, a sixth modification of the above-described embodiment will be described. FIG. 12A is a schematic diagram illustrating an antenna device 10K of the present modification. FIG. 12B is a schematic diagram illustrating an antenna device 10L of the present modification.

In the present modification, configurations in which the antenna device 10K or 10L substitutes for the antenna device 10 of the electronic timepiece 1 of the above-described embodiment are taken. Therefore, different parts will be mainly described.

As shown in FIG. 12A, the antenna device 10K includes a feed antenna 11K and the parasitic antenna 12. The feed antenna 11K includes four antenna elements 111K, two capacitors 117K, a 90-degree hybrid circuit 118 which is a feed means, and a resistor 119. The parasitic antenna 12 includes the antenna element 121.

The four antenna elements 111K are inverted L antenna elements disposed along the circumference of the antenna element 121, on the inner side by a predetermined distance, at regular intervals in the circumferential direction, and each are electromagnetically with the antenna element 121. Two of the four antenna elements 111K are grounded (electrically connected to the ground plate 13) via the capacitors 117K, respectively. Each of the other two of the four antenna elements 111K is electrically connected to the 90-degree hybrid circuit 118. The 90-degree hybrid circuit 118 is grounded (electrically connected to the ground plate 13) via the feed unit F and the resistor 119.

The 90-degree hybrid circuit 118 is a phase adjustment circuit, and adjusts phase and feeds power to two antenna elements 111K. Therefore, power is fed at four points to the four antenna elements 111K different in phase.

As shown in FIG. 12B, the antenna device 10L includes a feed antenna 11L and the parasitic antenna 12. The feed antenna 11L includes two antenna elements 111L and two connection parts 115L.

The two antenna elements 111L are inverted L antenna elements disposed along the circumference of the antenna element 121, on the inner side by a predetermined distance, at regular intervals in the circumferential direction, and each are electromagnetically with the antenna element 121. The two antenna elements 111L are electrically connected to feed units F1 and F2 which are feed means, via the connection parts 115L, respectively. By the feed units F1 and F2, power is fed at two points to the two antenna elements 111L different in phase.

As described above, according to the antenna device 10K of the present modification, the feed antenna 11K includes the four antenna elements 111K disposed on the inner side on the same plane with the parasitic antenna 12 and close to the parasitic antenna. The antenna device 10K includes the 90-degree hybrid circuit 118 and the feed unit F for making the phases of the four antenna elements 111K different and feeding power. For this reason, similarly to the antenna device 10, in the configuration having the parasitic antenna 12 which is a metal member, it is possible to have high communication performance, and it is possible to simplify the structure of the antenna device 10K, and it is possible to improve the degree of freedom of design of the antenna device 10K. Also, according to the antenna device 10K which has the four antenna elements 111K and in which the phases of them are made different and power is fed, as compared to the antenna device 10F of FIG. 9 which is a circular polarized antenna using one inverted L antenna element, it is possible to obtain a good axial ratio over a very wide band.

Also, according to the antenna device 10L of the present modification, the feed antenna 11L includes the two antenna elements 111L disposed on the inner side on the same plane with parasitic antenna 12 and close to the parasitic antenna. The antenna device 10L includes the feed units F1 and F2 for making the phases of the two antenna elements 111K different and feeding power. For this reason, similarly to the antenna device 10, in the configuration having the parasitic antenna 12 which is a metal member, it is possible to have high communication performance, and it is possible to simplify the structure of the antenna device 10L, and it is possible to improve the degree of freedom of design of the antenna device 10L. Also, according to the antenna device 10L which has the two antenna elements 111L and in which the phases are made different and power is fed, as compared to the antenna device 10F, it is possible to obtain a good axial ratio over a very wide band.

Also, in the antenna devices 10K and 10L, the antenna elements 111K and 111L are disposed on the inner side from the parasitic antenna 12 (the antenna element 121); however, the present invention is not limited thereto, and the antenna elements 111K and 111L may be disposed on the outer side from the parasitic antenna 12.

(Seventh Modification)

Figure 13A:
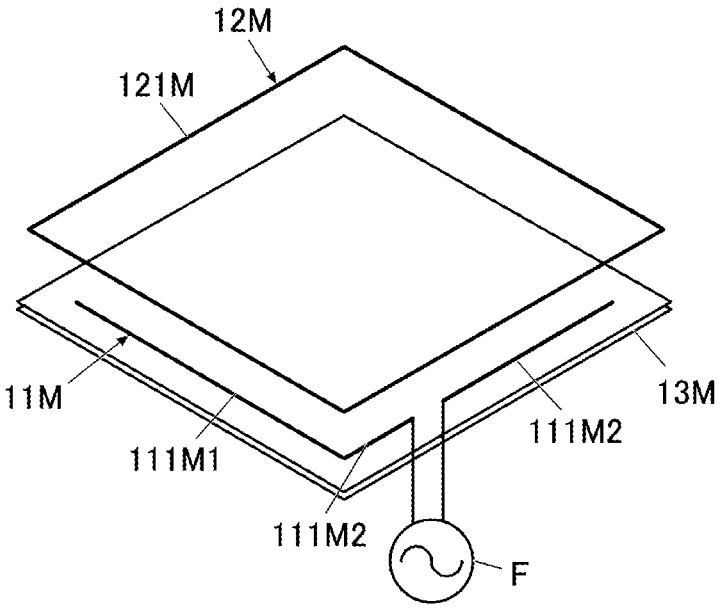
FIG. 13A is a schematic diagram illustrating an antenna device of a seventh modification.
Figure 13B:
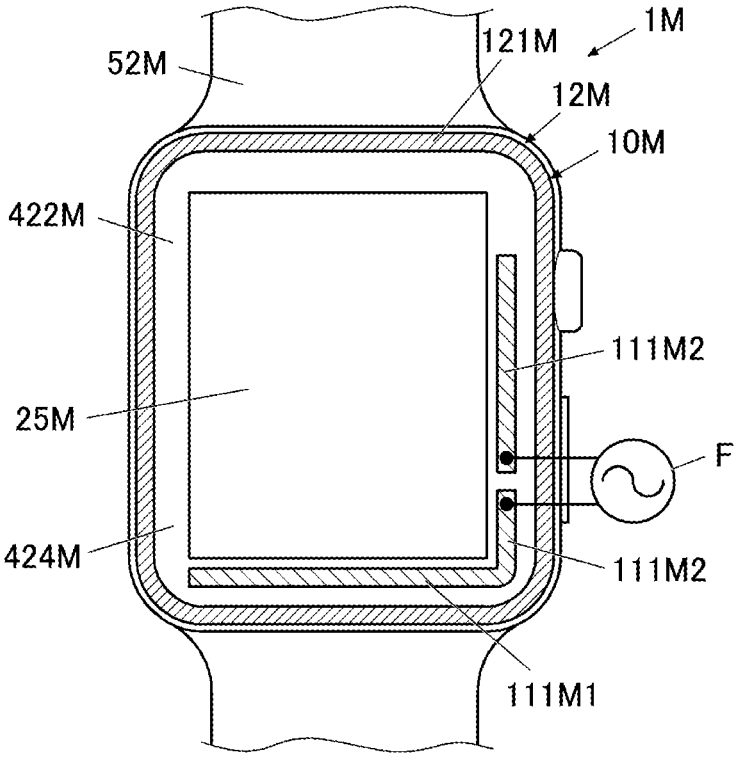
FIG. 13B is a schematic diagram illustrating an electronic timepiece of the seventh modification.

With reference to FIG. 13A to FIG. 13B, a seventh modification of the above-described embodiment will be described. FIG. 13A is a schematic diagram illustrating an antenna device 10M of the present modification. FIG. 13B is a schematic diagram illustrating an electronic timepiece 1M of the present modification.

In the present modification, a configuration in which the electronic timepiece 1M and the antenna device 10M substitute for the electronic timepiece 1 and the antenna device 10 of the above-described embodiment is taken. Therefore, different parts will be mainly described.

As shown in FIG. 13A, the antenna device 10M includes a feed antenna 11M, a parasitic antenna 12M, and a ground plate 13M. The feed antenna 11M includes antenna elements 111M1 and 111M2. The antenna element 111M1 is a straight antenna element. The antenna element 111M2 is a straight antenna element electrically connected to the antenna element 111M1.

The antenna element 111M1 and the antenna element 111M1 are spatially disposed so as to intersect each other at right angle. The feed antenna 11M has a contact point at which one end of the antenna element 111M1 and one end of the antenna element 111M2 are electrically connected so as to form an L shape, and in the antenna element 112, at a predetermined position close to the contact point within a distance corresponding to about ⅛ of the desired radar wave wavelenth λ, the electrical connection part with the feed unit F is provided, whereby the feed antenna is configured as a circular polarized antenna.

The parasitic antenna 12M includes an antenna element 121M. The antenna element 121M is an antenna element made of a metal and having a rectangular ring shape. It is assumed that the ground plate 13M is rectangular. In the present modification, with predetermined gaps from the top and the outer periphery of the feed antenna 11M, the annular parasitic antenna 12M is provided as a wave guide part.

The feed antenna 11M is configured, for example, such that the length of the antenna element 111M1 in the extension direction is longer than about ½ (or about ¼) of the desired radar wave wavelength λ, by a predetermined length, and the length of the antenna element 111M2 in the extension direction is shorter than about ½ (or about ¼) of the desired radar wave wavelength λ, by a predetermined length, and the sum of the lengths of the antenna element 111M1 and antenna element 111M2 in their extension directions become about the desired radar wave wavelength λ, (or about ½ of the wavelength).

As shown in FIG. 13B, the electronic timepiece 1M includes a windshield 422M, a window parting unit 424M, a display unit 25M, the antenna device 10M, the rear lid back 48M, a band 52M, and so on. The windshield 422M is the same as the windshield 422, but is an almost rectangular windshield. The display unit 25M is the same as the display unit 25, but is an almost rectangular display unit. The window parting unit 424M is a window parting unit for the display unit 25M. The rear lid back 48M is an almost rectangular rear lid back for the electronic circuit module such as the display unit 25M. The band 52M is a band for the rear lid back 48M.

As described above, according to the antenna device 10M of the present modification, the feed antenna 11M is an L-shaped antenna having the straight antenna element 111M1, and the straight antenna element 111M2 electrically connected to the antenna element 111M1 at the contact point. To the antenna element 111M2, power is fed at a point within about ⅛ of the desired radar wave wavelength λ, from the contact point. For this reason, similarly to the antenna device 10, in the configuration having the parasitic antenna 12M which is a metal member, it is possible to have high communication performance, and it is possible to simplify the structure of the antenna device 10M, and it is possible to improve the degree of freedom of design of the antenna device 10M.

Also, the length of the antenna element 111M1 is shorter than the length of the antenna element 111M2 by ½ or ¼ of the desired radar wave wavelength λ. The sum of the length of the antenna element 111M1 and the length of the antenna element 111M2 is the desired radar wave wavelength λ or ½ thereof. Therefore, in the antenna device 10M, since radiation and reception of circularly polarized waves are possible by only one-point power feeding, it is possible to make a complex feed circuit unnecessary, and it is possible to reduce the planar expansion and occupation area of the antenna elements. Therefore, it is possible to use the antenna device as a circular polarized antenna suitable to be provided in the electronic timepiece 1M which is a small-sized device.

However, the above description of the embodiment and the modifications are examples of antenna devices and wristwatch type electronic devices according to the present invention, and the present invention is not limited thereto.

For example, in the embodiment and the modifications, as wristwatch type electronic devices, the electronic timepieces have been described; however, the present invention is not limited thereto. Wristwatch type electronic devices may be other electronic devices such as smart watches.

Also, in the embodiment and the modifications, the antenna devices for receiving radar waves which are circularly polarized waves from GNSS satellites have been described; however, the present invention is not limited thereto. Antenna devices may have configurations for receiving other radar waves, for example, radar waves of satellite broadcasts such as 2K BS (Broadcasting Satellite) broadcasts, 110-degree CS (communications Satellite) broadcasts (right-handed circularly polarized waves), 4K BS broadcasts (right-handed/left-handed circularly polarized waves), 8K BS broadcasts (left-handed circularly polarized waves), and 4K 110-degree CS broadcasts (left-handed circularly polarized waves). Also, antenna devices may have configurations using an antenna for receiving circularly polarized waves from GNSS satellites and the like, and another antenna for radar wave communication such as Wi-Fi (registered as a trade mark) or Bluetooth (registered as a trade mark) together.

Although the embodiment and modifications of the present invention have been described, the scope of the present invention is not limited to the above-described embodiment, and includes the scopes of inventions disclosed in claims and the scopes of their equivalents.

What is claimed is:

1. An antenna device comprising:

a metal member which is used as a windshield fixing frame of a wristwatch type electronic device; and a feed antenna which is a conductor, wherein the metal member has an annular shape, is disposed adjacent to the feed antenna, is electromagnetically or capacitively coupled with the feed antenna, and acts as a parasitic antenna to which power is fed from the feed antenna in a non-contact manner, the feed antenna and the metal member act in cooperation with each other as a circular polarized antenna for receiving radar waves which are circularly polarized waves having a predetermined frequency, the feed antenna includes an antenna element extending in an arc in an extension direction and a connection part configured to connect the antenna element and a GND, and a sum of a length of the antenna element in the extension direction and a length of the connection part is longer than a perimeter of the metal member that acts as the parasitic antenna.

2. The antenna device according to claim 1, wherein the metal member is formed in a case part for storing the antenna device by insert molding, and acts as a loop type parasitic antenna.

3. The antenna device according to claim 1, wherein the metal member is formed on a case part for storing the antenna device by outsert molding, and acts as a loop type parasitic antenna.

4. The antenna device according to claim 1, wherein the metal member is a case part for storing the antenna device, and acts as a loop type parasitic antenna.

5. The antenna device according to claim 1, wherein the feed antenna is mounted on an electronic circuit module disposed inside the metal member and below the windshield.

6. The antenna device according to claim 1, wherein the feed antenna is an inverted F antenna, and the sum of the length of the antenna element in the extension direction and the length of the connection part is set to a length corresponding to the predetermined frequency.

7. The antenna device according to claim 2, wherein the feed antenna is an inverted F antenna, and the sum of the length of the antenna element in the extension direction and the length of the connection part is set to a length corresponding to the predetermined frequency.

8. The antenna device according to claim 3, wherein the feed antenna is an inverted F antenna, and the sum of the length of the antenna element in the extension direction and the length of the connection part is set to a length corresponding to the predetermined frequency.

9. The antenna device according to claim 4, wherein the feed antenna is an inverted F antenna, and the sum of the length of the antenna element in the extension direction and the length of the connection part is set to a length corresponding to the predetermined frequency.

10. The antenna device according to claim 5, wherein the feed antenna is an inverted F antenna, and the sum of the length of the antenna element in the extension direction and the length of the connection part is set to a length corresponding to the predetermined frequency.

11. The antenna device according to claim 6, wherein the feed antenna further includes a ground part which is grounded via a capacitor.

12. The antenna device according to claim 1, wherein the feed antenna is an inverted L antenna.

13. The antenna device according to claim 1, wherein the feed antenna includes an annular, spiral, or C-shaped antenna element disposed in parallel at a predetermined distance from the metal member.

14. The antenna device according to claim 13, wherein a perimeter of the metal member is shorter than a length of the annular, C-shaped, or spiral antenna element in an extension direction by a predetermined length.

15. The antenna device according to claim 1, wherein the feed antenna includes a C-shaped antenna element disposed adjacent to and inside the metal member, and a perimeter of the metal member is longer than a length of the C-shaped antenna element in an extension direction by a predetermined length.

16. The antenna device according to claim 1, wherein the feed antenna includes a plurality of antenna elements disposed adjacent to and inside the metal member, and has one feed point for feeding power such that phases of the plurality of antenna elements are different.

17. The antenna device according to claim 1, wherein the feed antenna is an L-shaped antenna element part including a straight first antenna element, and a straight second antenna element electrically connected to the first antenna element, and the second antenna element is connected to a feed point at a position within a length corresponding to ⅛ of the predetermined wavelength from a contact point of the first antenna element and the second antenna element.

18. The antenna device according to claim 17, wherein a length of the first antenna element is shorter than a length of the second antenna element by a length corresponding to ½ or ¼ of the predetermined wavelength, and the sum of the length of the first antenna element and the length of the second antenna element is a length corresponding to the predetermined wavelength or ½ thereof.

19. The antenna device according to claim 1, wherein the metal member is made of an elastic material, and is used to reinforce waterproof performance.

20. The antenna device according to claim 1, wherein the antenna device is included in the wristwatch type electronic device.

* * * * *